US011682336B2

(12) United States Patent
An et al.

(10) Patent No.: US 11,682,336 B2
(45) Date of Patent: Jun. 20, 2023

(54) DISPLAY APPARATUS HAVING VARIABLE FREQUENCY MODE AND METHOD OF DRIVING THE SAME

(71) Applicant: Samsung Display Co., Ltd., Yongin-Si (KR)

(72) Inventors: Tae Hyeong An, Hwaseong-si (KR); Hoi Sik Moon, Hwaseong-si (KR); Yoon Gu Kim, Seoul (KR); Jin Pil Kim, Suwon-si (KR); Jae Sung Bae, Suwon-si (KR); Nam Jae Lim, Gwacheon-si (KR); Ik Hyun Ahn, Hwaseong-si (KR); Seung Young Choi, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 0 days.

(21) Appl. No.: 17/198,441

(22) Filed: Mar. 11, 2021

(65) Prior Publication Data

US 2021/0287595 A1 Sep. 16, 2021

(30) Foreign Application Priority Data

Mar. 11, 2020 (KR) ..... 10-2020-0030261

(51) Int. Cl.
*G09G 3/20* (2006.01)

(52) U.S. Cl.
CPC ..... *G09G 3/2092* (2013.01); *G09G 2310/027* (2013.01); *G09G 2310/0243* (2013.01);
(Continued)

(58) Field of Classification Search
CPC ..... G09G 3/2092; G09G 3/32–3291; G09G 3/36–3696; G09G 2310/0243; G09G 2310/0254; G09G 2310/0256; G09G 2310/0267; G09G 2310/027; G09G 2310/0289; G09G 2310/08; G09G 2320/02; G09G 2320/0233–0247; G09G 2320/0257; G09G 2320/0271;
(Continued)

(56) References Cited

U.S. PATENT DOCUMENTS

2017/0004798 A1* 1/2017 Park ..... G09G 3/3648
2017/0061927 A1* 3/2017 Yoon ..... G09G 5/026
(Continued)

FOREIGN PATENT DOCUMENTS

KR 1020170028479 A 3/2017
KR 1020180039232 A 4/2018
(Continued)

*Primary Examiner* — Nathan Danielsen
(74) *Attorney, Agent, or Firm* — Cantor Colburn LLP

(57) ABSTRACT

A display apparatus includes a display panel, a driving controller and a data driver. The driving controller processes input image data according to a variable input frequency and generates a data signal having a varied frame length. The data driver converts the data signal into a data voltage and outputs the data voltage to the display panel. The driving controller determines a variable frequency mode and generates an asymmetric data signal including a positive data signal and a negative data signal which are asymmetric with respect to a common voltage for a same grayscale value in the variable frequency mode.

20 Claims, 8 Drawing Sheets

(52) U.S. Cl.
CPC . *G09G 2310/08* (2013.01); *G09G 2320/0233* (2013.01); *G09G 2320/0247* (2013.01); *G09G 2320/0673* (2013.01); *G09G 2340/0435* (2013.01)

(58) Field of Classification Search
CPC ... G09G 2320/0276; G09G 2320/0666; G09G 2320/0673; G09G 2320/10; G09G 2320/103; G09G 2340/0407; G09G 2340/0435; G09G 2340/14; G09G 2360/12; G09G 2360/127; G09G 2360/16; G09G 2360/18
See application file for complete search history.

(56) References Cited

U.S. PATENT DOCUMENTS

| | | | | |
|---|---|---|---|---|
| 2018/0122327 | A1* | 5/2018 | Kim | G09G 3/3648 |
| 2019/0130853 | A1* | 5/2019 | Zhu | G09G 3/36 |
| 2019/0206356 | A1* | 7/2019 | Kim | G09G 3/3655 |
| 2020/0035173 | A1* | 1/2020 | Kim | G09G 3/3607 |
| 2020/0160792 | A1* | 5/2020 | Park | G09G 3/3677 |
| 2020/0265769 | A1* | 8/2020 | Pyo | G09G 3/2003 |
| 2020/0320923 | A1* | 10/2020 | Choi | G09G 3/3688 |

FOREIGN PATENT DOCUMENTS

| | | | |
|---|---|---|---|
| KR | 1020190069667 | A | 6/2019 |
| KR | 1020200029101 | A | 3/2020 |

* cited by examiner

DISPLAY APPARATUS HAVING VARIABLE FREQUENCY MODE AND METHOD OF DRIVING THE SAME

This application claims priority to Korean Patent Application No. 10-2020-0030261, filed on Mar. 11, 2020, and all the benefits accruing therefrom under 35 U.S.C. § 119, the content of which in its entirety is herein incorporated by reference.

BACKGROUND

1. Field

Embodiments of the invention relate to a display apparatus and a method of driving the display apparatus. More particularly, embodiments of the invention relate to a display apparatus synchronized with a variable frequency and a method of driving the display apparatus.

2. Description of the Related Art

A display apparatus includes a display panel and a display panel driver. The display panel driver includes a driving controller, a gate driver and a data driver. The driving controller adjusts driving timings of the gate driver and the data driver. The gate driver outputs gate signals to gate lines, and the data driver outputs data voltages to data lines.

A host which provides input image data to the driving controller may provide the input image data at a variable frequency. The driving controller processes the input image data in synchronization with the variable frequency.

SUMMARY

When a display panel displays an image at a variable frequency, a difference of a luminance of the image may be generated according to the frame rate and a display defect may be shown due to the difference of the luminance of the image.

Embodiments of the invention provide a display apparatus synchronized with a variable frequency and capable of enhancing the display quality.

Embodiments of the invention also provide a method of driving the display apparatus.

In an embodiment of a display apparatus according to the invention, the display apparatus includes a display panel, a driving controller and a data driver. The driving controller processes input image data according to a variable input frequency and generates a data signal having a varied frame length. The data driver converts the data signal into a data voltage and to output the data voltage to the display panel. The driving controller determines a variable frequency mode and generates an asymmetric data signal including a positive data signal and a negative data signal which are asymmetric with respect to a common voltage for a same grayscale value in the variable frequency mode.

In an embodiment, the driving controller may determine whether an initial variable frequency mode starts or not. The driving controller may determine that the variable input frequency of the input image data is changed in the initial variable frequency mode and determine the variable frequency mode.

In an embodiment, when a pixel clock of a current frame is equal to a pixel clock of a maximum input frequency, the driving controller may determine that the initial variable frequency mode starts.

In an embodiment, when the driving controller receives a variable frequency mode signal from a host, the driving controller may determine that the initial variable frequency mode starts.

In an embodiment, the driving controller may compare lengths of vertical blank periods of N frames, where N is a natural number equal to or greater than two, and determine that the variable input frequency changes when at least one of the vertical blank periods has a different length.

In an embodiment, when the variable input frequency of the input image data is determined to be fixed, the variable frequency mode may be terminated.

In an embodiment, the driving controller may compare lengths of vertical blank periods of N frames, where N is a natural number equal to or greater than two, and determine that the variable input frequency is fixed when the lengths of the vertical blank periods of the N frames are identical.

In an embodiment, the driving controller may generate the asymmetric data signal having an asymmetric value which is regardless of the variable input frequency and which is varied according to a grayscale value of the input image data in a first frame of the variable frequency mode.

In an embodiment, the driving controller may generate the asymmetric data signal having an asymmetric value varied according to the variable input frequency and the grayscale value of the input image data in subsequent frames of the variable frequency mode after the first frame of the variable frequency mode.

In an embodiment, in a second frame of the variable frequency mode, the driving controller may generate the asymmetric data signal based on the variable input frequency of the first frame of the variable frequency mode.

In an embodiment, the driving controller may generate the asymmetric data signal having an asymmetric value varied according to the variable input frequency and a grayscale value of the input image data in the variable frequency mode.

In an embodiment, in a first frame of the variable frequency mode, the driving controller may generate the asymmetric data signal based on an input frequency of a last frame prior to the variable frequency mode.

In an embodiment, the driving controller may generate the asymmetric data signal for a grayscale value which is equal to or less than a threshold grayscale value.

In an embodiment, the positive data signal of the asymmetric data signal may have a value less than a value of a positive data signal of a symmetric data signal. The negative data signal of the asymmetric data signal may have a value less than a value of a negative data signal of the symmetric data signal.

In an embodiment of a method of driving a display apparatus, the method includes processing input image data according to a variable input frequency to generate a data signal having a varied frame length, converting the data signal into a data voltage and outputting the data voltage to a display panel. The processing the input image data includes determining a variable frequency mode and generating an asymmetric data signal including a positive data signal and a negative data signal which are asymmetric with respect to a common voltage for a same grayscale value in the variable frequency mode.

In an embodiment, the determining the variable frequency mode may include determining whether an initial variable frequency mode starts or not and determining that the variable input frequency of the input image data is changed in the initial variable frequency mode to determine the variable frequency mode.

In an embodiment, the determining the variable frequency mode may further include determining that the variable frequency mode is terminated when the variable input frequency of the input image data is determined to be fixed.

In an embodiment, the asymmetric data signal may have an asymmetric value which is regardless of the variable input frequency and which is varied according to a grayscale value of the input image data in a first frame of the variable frequency mode.

In an embodiment, the asymmetric data signal may have an asymmetric value varied according to the variable input frequency and the grayscale value of the input image data in subsequent frames of the variable frequency mode after the first frame of the variable frequency mode.

In an embodiment, the asymmetric data signal may have an asymmetric value varied according to the variable input frequency and a grayscale value of the input image data in the variable frequency mode.

According to the display apparatus and the method of driving the display apparatus, the display panel is driven using the asymmetric data signal having the positive data signal and the negative data signal which are asymmetric with respect to the common voltage in the variable frequency mode so that the difference of the luminance of the image according to the frequency may be prevented.

In addition, the variable frequency mode is accurately determined so that the display defect due to the asymmetric data signal in the fixed frequency mode may be prevented.

Thus, the display quality of the display panel displaying the image in the variable frequency may be enhanced.

BRIEF DESCRIPTION OF THE DRAWINGS

The above and other features and advantages of the invention will become more apparent by describing in detailed embodiments thereof with reference to the accompanying drawings, in which.

DETAILED DESCRIPTION

Figure 1:
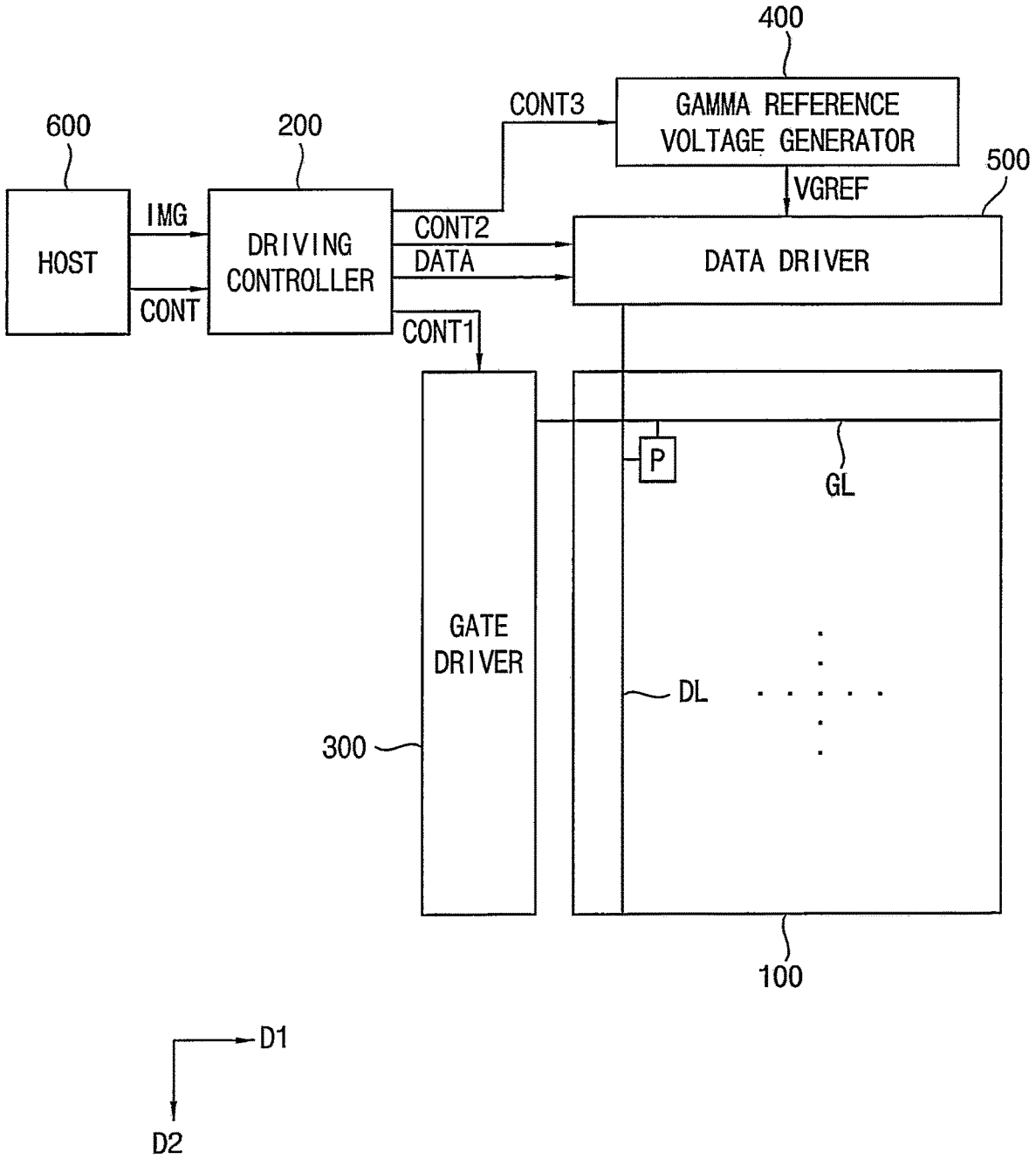
FIG. 1 is a block diagram illustrating an embodiment of a display apparatus according to the invention.

Hereinafter, the invention will be explained in detail with reference to the accompanying drawings.

It will be understood that when an element is referred to as being "on" another element, it can be directly on the other element or intervening elements may be therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. In an embodiment, when the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, when the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the invention, and will not be interpreted in an idealized or overly formal sense unless expressly so defined herein.

Embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. In an embodiment, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the claims.

FIG. 1 is a block diagram illustrating an embodiment of a display apparatus according to the invention.

Referring to FIG. 1, the display apparatus includes a display panel 100 and a display panel driver. The display panel driver includes a driving controller 200, a gate driver 300, a gamma reference voltage generator 400 and a data driver 500. The display apparatus may further include a host 600.

In an embodiment, the driving controller 200 and the data driver 500 may be unitary, for example. In an embodiment, the driving controller 200, the gamma reference voltage generator 400 and the data driver 500 may be unitary, for example. A driving module including at least the driving controller 200 and the data driver 500 which are unitary may be referred to as to a timing controller embedded data driver ("TED").

The display panel 100 includes a plurality of gate lines GL, a plurality of data lines DL and a plurality of pixels P connected to the gate lines GL and the data lines DL. The gate lines GL extend in a first direction D1 and the data lines DL extend in a second direction D2 crossing the first direction D1.

In an embodiment, the display panel 100 may be a liquid crystal display panel including a liquid crystal layer, for example. In an alternative embodiment, the display panel 100 may be an organic light emitting display panel including an organic light emitting element, for example.

The driving controller 200 receives input image data IMG and an input control signal CONT from the host 600. In an embodiment, the input image data IMG may include red image data, green image data and blue image data, for example. In an embodiment, the input image data IMG may include white image data, for example. In an embodiment, the input image data IMG may include magenta image data, yellow image data and cyan image data, for example. The input control signal CONT may include a master clock signal and a data enable signal. The input control signal CONT may further include a vertical synchronization signal and a horizontal synchronization signal.

The driving controller 200 generates a first control signal CONT1, a second control signal CONT2, a third control signal CONT3 and a data signal DATA based on the input image data IMG and the input control signal CONT.

The driving controller 200 generates the first control signal CONT1 for controlling an operation of the gate driver 300 based on the input control signal CONT, and outputs the first control signal CONT1 to the gate driver 300. The first control signal CONT1 may further include a vertical start signal and a gate clock signal.

The driving controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The driving controller 200 generates the data signal DATA based on the input image data IMG. The driving controller 200 outputs the data signal DATA to the data driver 500.

In the embodiment, the driving controller 200 may process the input image data according to a variable input frequency and generate a data signal DATA having a variable frame length, for example.

The driving controller 200 generates the third control signal CONT3 for controlling an operation of the gamma reference voltage generator 400 based on the input control signal CONT, and outputs the third control signal CONT3 to the gamma reference voltage generator 400.

A structure and an operation of the driving controller 200 are explained referring to FIGS. 2 to 9 in detail.

The gate driver 300 generates gate signals driving the gate lines GL in response to the first control signal CONT1 received from the driving controller 200. The gate driver 300 outputs the gate signals to the gate lines GL. In an embodiment, the gate driver 300 may sequentially output the gate signals to the gate lines GL, for example. In an embodiment, the gate driver 300 may be disposed (e.g., mounted) on the display panel 100, for example. In an embodiment, the gate driver 300 may be integrated on the display panel 100, for example.

The gamma reference voltage generator 400 generates a gamma reference voltage VGREF in response to the third control signal CONT3 received from the driving controller 200. The gamma reference voltage generator 400 provides the gamma reference voltage VGREF to the data driver 500. The gamma reference voltage VGREF has a value corresponding to a level of the data signal DATA.

In an embodiment, the gamma reference voltage generator 400 may be disposed in the driving controller 200, or in the data driver 500.

The data driver 500 receives the second control signal CONT2 and the data signal DATA from the driving controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The host 600 may output the input image data IMG and the input control signal CONT to the driving controller 200. In an embodiment, the host 600 may output a variable frequency mode signal representing that the input image data IMG have a variable frequency, for example. In an embodiment, the host 600 may be a graphic processing unit, for example.

Figure 2:
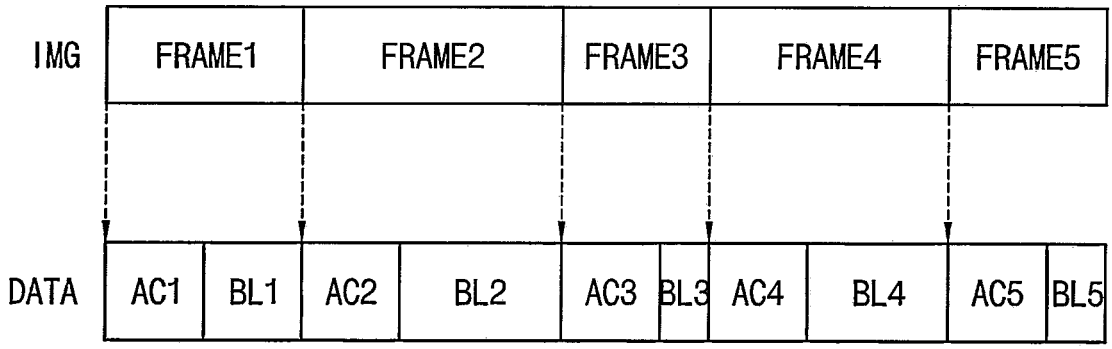
FIG. 2 is a conceptual diagram illustrating image processing of a driving controller of FIG. 1.

FIG. 2 is a conceptual diagram illustrating image processing of the driving controller 200 of FIG. 1.

Referring to FIGS. 1 and 2, the host 600 may output the input image data IMG having the variable input frequency to the driving controller 200.

The driving controller 200 may generate the data signal DATA having the variable frame length by processing the input image data IMG having the variable input frequency.

The data signal DATA may include an active period AC1, AC2, AC3, AC4 and AC5 and a blank period BL1, BL2, BL3, BL4 and BL5. The data signal DATA may include grayscale data in the active period AC1, AC2, AC3, AC4 and AC5. The data signal DATA may not include grayscale data in the blank period BL1, BL2, BL3, BL4 and BL5. In an embodiment, the active period AC1, AC2, AC3, AC4 and AC5 may correspond to a scanning period of the gate signal, for example. In an embodiment, the blank period BL1, BL2, BL3, BL4 and BL5 may correspond to a non-scanning period of the gate signal, for example. The blank period BL1, BL2, BL3, BL4 and BL5 may be also referred to as a vertical blank period.

The driving controller 200 may adjust the length of the blank period BL1, BL2, BL3, BL4 and BL5 of the data signal DATA according to the variable input frequency. In contrast, the length of the active period AC1, AC2, AC3, AC4 and AC5 may be uniform regardless of the variable input frequency. The driving controller 200 may set the length of the active period AC1, AC2, AC3, AC4 and AC5 based on a maximum input frequency of the input image data IMG.

In FIG. 2, a first frame data signal having a first active period AC1 and a first blank period BL1 may be generated corresponding to a first frame FRAME1 having a first input frequency.

A second frame data signal having a second active period AC2 and a second blank period BL2 may be generated corresponding to a second frame FRAME2 having a second input frequency. In an embodiment, the second input frequency may be lower than the first input frequency, for example. Thus, the length of the second frame FRAME2 may be longer than the length of the first frame FRAME1. The length of the second active period AC2 may be substantially the same as the length of the first active period AC1. The length of the second blank period BL2 may be longer than the length of the first blank period BL1.

A third frame data signal having a third active period AC3 and a third blank period BL3 may be generated corresponding to a third frame FRAME3 having a third input frequency. In an embodiment, the third input frequency may be higher than the first input frequency, for example. Thus, the length of the third frame FRAME3 may be shorter than the length of the first frame FRAME1. The length of the third active period AC3 may be substantially the same as the length of the first active period AC1. The length of the third blank period BL3 may be shorter than the length of the first blank period BL1.

A fourth frame data signal having a fourth active period AC4 and a fourth blank period BL4 may be generated corresponding to a fourth frame FRAME4 having a fourth input frequency. In an embodiment, the fourth input frequency may be lower than the first input frequency, for example. The length of the fourth active period AC4 may be substantially the same as the length of the first active period AC1. The length of the fourth blank period BL4 may be longer than the length of the first blank period BL1.

A fifth frame data signal having a fifth active period AC5 and a fifth blank period BL5 may be generated corresponding to a fifth frame FRAME5 having a fifth input frequency. In an embodiment, the fifth input frequency may be higher than the first input frequency, for example. The length of the fifth active period AC5 may be substantially the same as the length of the first active period AC1. The length of the fifth blank period BL5 may be shorter than the length of the first blank period BL1.

As explained above, the driving controller 200 may process the input image data IMG according to the variable input frequency to generate the data signal DATA having the variable frame length.

Figure 3:
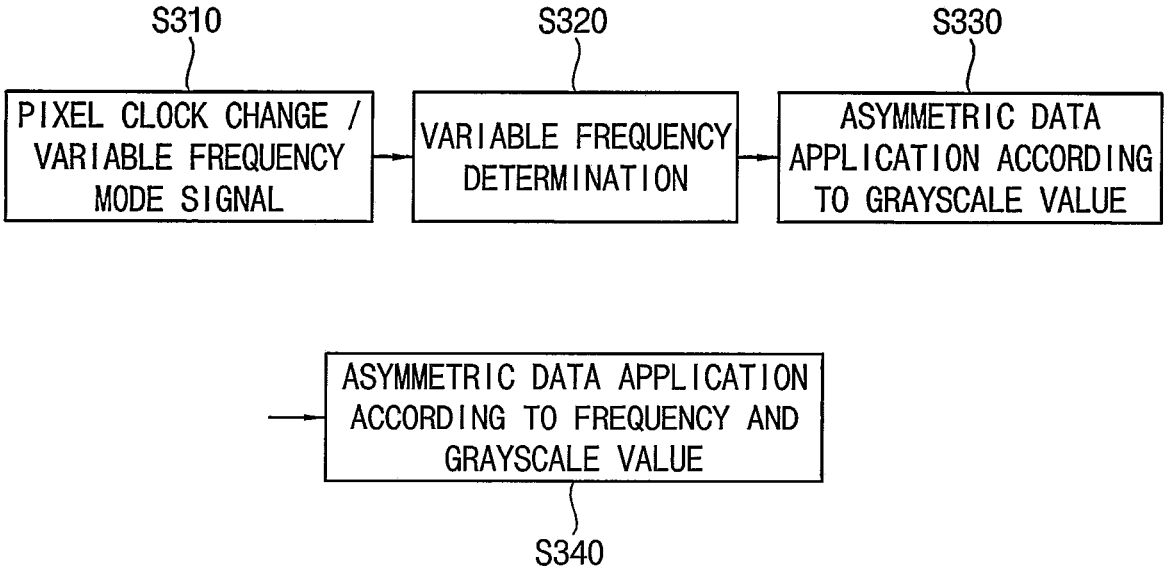
FIG. 3 is a conceptual diagram illustrating an operation of the driving controller of FIG. 1.
Figure 4:
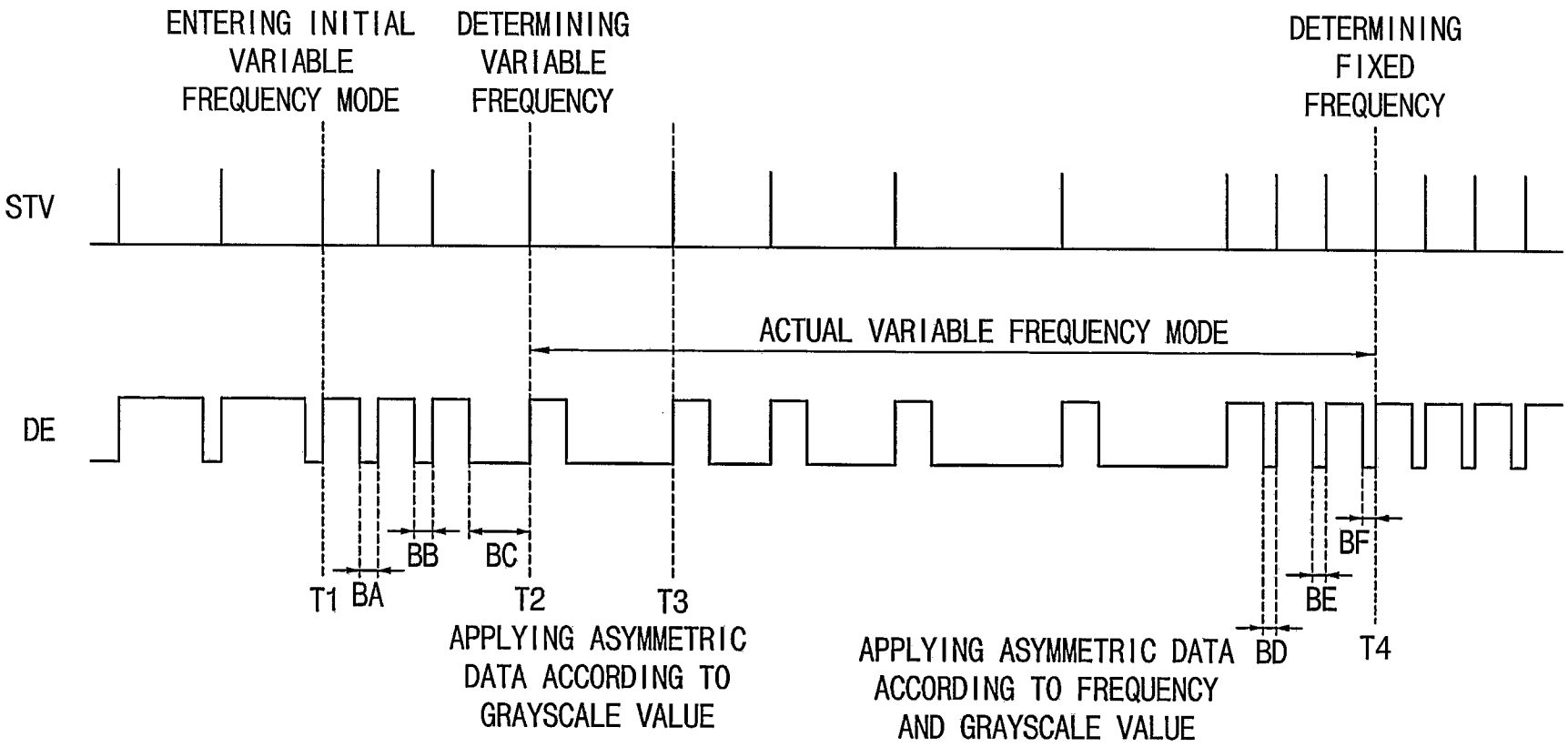
FIG. 4 is a timing diagram illustrating the operation of the driving controller of FIG. 1.

FIG. 3 is a conceptual diagram illustrating an operation of the driving controller 200 of FIG. 1. FIG. 4 is a timing diagram illustrating the operation of the driving controller 200 of FIG. 1.

Referring to FIGS. 1 to 4, the driving controller 200 may determine a variable frequency mode and generate an asymmetric data signal DATA including a positive data signal and a negative data signal which are asymmetric with respect to a common voltage for the same grayscale value in the variable frequency mode.

In an embodiment, the variable frequency mode may be a gaming mode which means that a user plays a game, for example. The variable frequency mode may be also referred to as a free sync mode.

In FIG. 4, a pulse of a vertical start signal STV may represent a start point of a frame of the input image data IMG and a data enable signal DE may represent a vertical active period (corresponding to a high period of the data enable signal DE) and a vertical blank period (corresponding to a low period of the data enable signal DE) of the input image data IMG.

The driving controller 200 may determine whether an initial variable frequency mode starts or not and determine whether the input frequency of the input image data IMG is changed in the initial variable frequency mode to accurately determine the variable frequency mode (operation S310).

In the embodiment, when a pixel clock of a current frame is equal to a pixel clock of the maximum input frequency, the driving controller 200 may determine that the initial variable frequency mode starts. The pixel clock may be represented as a multiplication of a horizontal resolution, a vertical resolution and the input frequency. The horizontal resolution may correspond to both a horizontal active period and a horizontal black period. The vertical resolution may correspond to both the vertical active period and the vertical black period. In an embodiment, the maximum input frequency may be about 240 hertz (Hz), for example.

In an embodiment, when the pixel clock corresponds to about 60 Hz and then the pixel clock has changed to correspond to about 240 Hz, for example, the driving controller 200 may determine the initial variable frequency mode starts.

In an embodiment, when the driving controller 200 receives the variable frequency mode signal from the host 600, the driving controller 200 may determine that the initial variable frequency mode starts. When the host 600 outputs the variable frequency mode signal to the driving controller 200, the driving controller 200 may relatively easily determine that the initial variable frequency mode starts.

The driving controller 200 may determine whether the input frequency of the input image data IMG is changed in the initial variable frequency mode to determine the variable frequency mode (operation S320).

In an embodiment, the driving controller 200 may compare lengths of the vertical blank periods of N frames, where N is a natural number equal to or greater than two, and determine that the input frequency changes when at least one of the vertical blank periods has a different length, for example.

Although N is three in FIG. 4 for convenience of explanation, the invention may not be limited thereto. In an embodiment, N may be set long enough for variable frequency determination and fixed frequency determination, for example. In an embodiment, N may have a value in ten-thousands, for example.

The driving controller 200 compares lengths of the vertical blank periods of N frames and determines that the input frequency is variable when at least one of the vertical blank periods has a different length. Thus, when a length of the vertical blank period of a previous frame is different from a length of the vertical blank period of a current frame, the driving controller 200 may immediately determine that the input frequency is variable.

In FIG. 4, the initial variable frequency mode starts at a first time point T1 and a length of a first vertical blank period BA of a first frame of the initial variable frequency mode is equal to a length of a second vertical blank period BB of a second frame of the initial variable frequency mode so that the driving controller 200 does not determine that the input frequency is variable in the second frame of the initial variable frequency mode.

The length of the second vertical blank period BB of the second frame of the initial variable frequency mode is different from a length of a third vertical blank period BC of a third frame of the initial variable frequency mode so that the driving controller 200 may determine that the input frequency is variable in the third frame of the initial variable frequency mode.

The driving controller 200 may apply the asymmetric data signal DATA from a second time point T2 which corresponds to a start point of a fourth frame of the initial variable frequency mode to drive the display apparatus.

When the variable frequency mode starts (at the second time point T2), the frequency may be varied for each frame. However, when the frequencies of the frames are fixed for a predetermined time period, the variable frequency mode may be terminated. When the asymmetric data signal DATA is continuously applied even when the frequency is fixed, a display quality may be deteriorated.

When the driving controller 200 determines that the frequency is fixed, the driving controller 200 may determine that the variable frequency mode is terminated. When the variable frequency mode is terminated, the display apparatus may be operated in a fixed frequency mode.

In an embodiment, the driving controller 200 may compare the lengths of the vertical blank periods of N frames and determine that the input frequency is fixed when the lengths of the vertical blank periods of N frames are all the same, for example.

As explained above, although N is three in FIG. 4 for convenience of explanation, the invention may not be limited thereto. In an embodiment, N may be set long enough for variable frequency determination and fixed frequency determination, for example.

In FIG. 4, after the variable frequency mode starts (at the second time point T2), the frequency may be varied for each frame. However, when the lengths of the vertical blank periods are all the same for N (e.g. three) frames such as BD, BE and BF, the driving controller 200 may determine that the input frequency is fixed (at a fourth time point T4).

Figure 5:
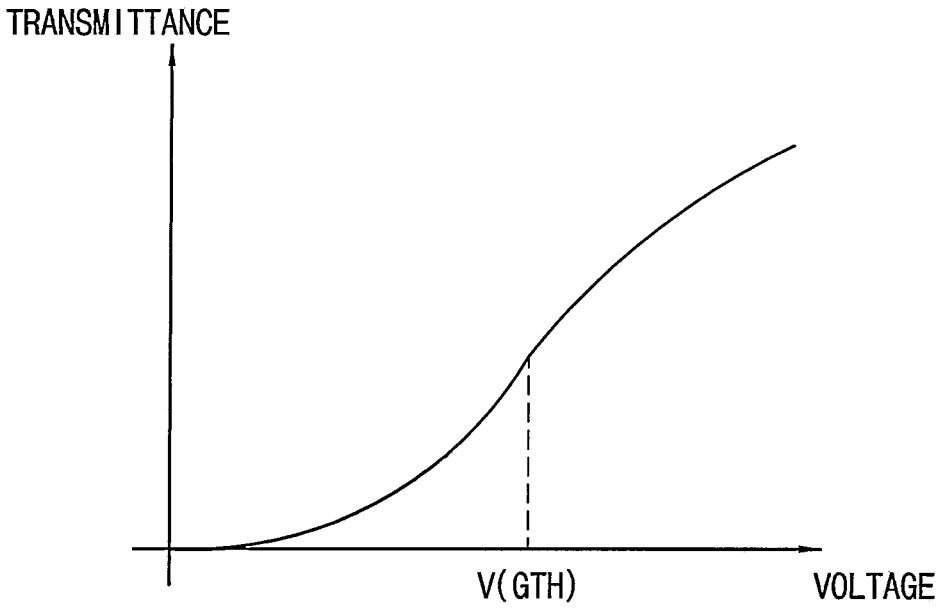
FIG. 5 is a graph illustrating a voltage-transmittance curve of a display panel of FIG. 1.
Figure 6:
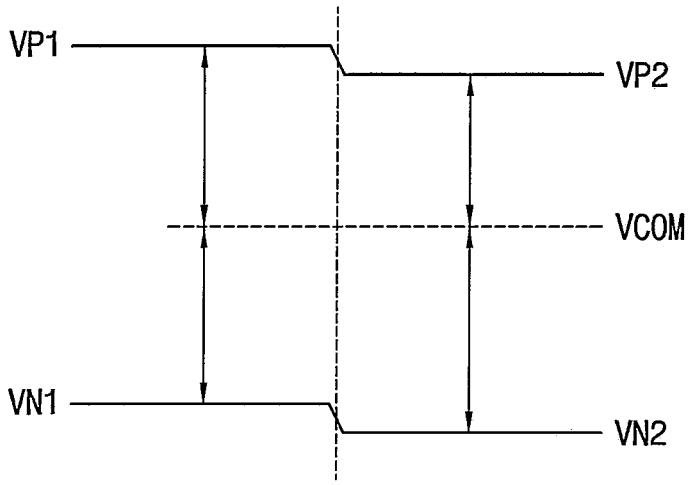
FIG. 6 is a conceptual diagram illustrating asymmetric data generated by the driving controller of FIG. 1.
Figure 7:
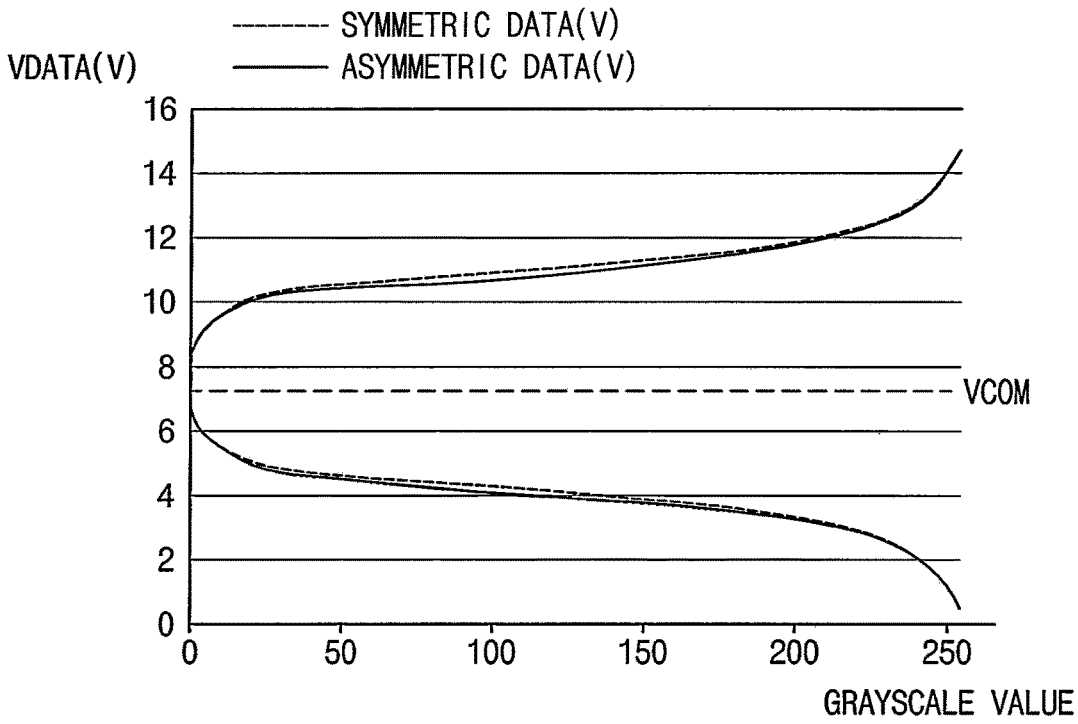
FIG. 7 is a graph illustrating asymmetric data according to a grayscale value generated by the driving controller of FIG. 1.
Figure 8:
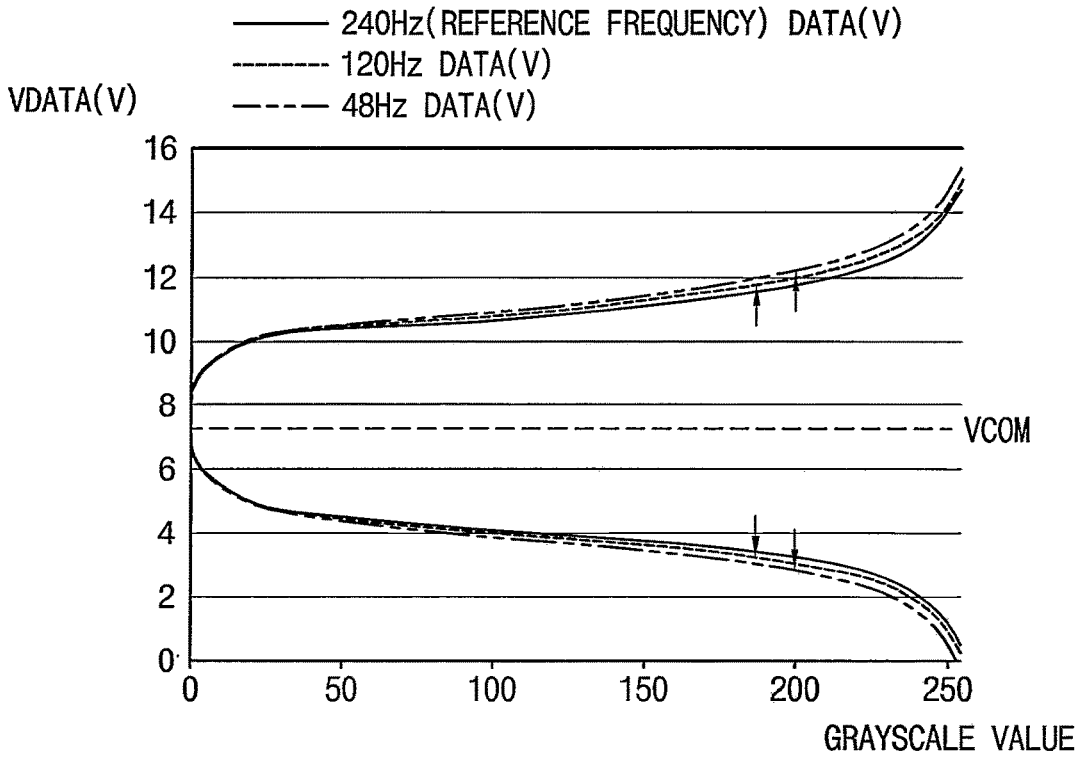
FIG. 8 is a graph illustrating asymmetric data according to a frequency and the grayscale value generated by the driving controller of FIG. 1.

FIG. 5 is a graph illustrating a voltage-transmittance curve of the display panel 100 of FIG. 1. FIG. 6 is a conceptual diagram illustrating asymmetric data generated by the driving controller 200 of FIG. 1. FIG. 7 is a graph illustrating asymmetric data according to the grayscale value generated by the driving controller 200 of FIG. 1. FIG. 8 is a graph illustrating asymmetric data according to the frequency and the grayscale value generated by the driving controller 200 of FIG. 1.

Referring to FIGS. 1 to 8, in the first frame T2-T3 (between the second time point T2 and a third time point T3) of the variable frequency mode, the driving controller 200 may generate the asymmetric data signal DATA having an asymmetric value which is regardless of the input frequency and which is varied according to the grayscale value of the input image data IMG (operation S330).

When the data signal is not compensated (e.g. when the data signal is a symmetric data signal including a positive data signal and a negative data signal which are symmetric with respect to the common voltage) in the first frame of the variable frequency mode, the luminance of the display image may be reduced. Due to the decrease of the luminance of the display image, a flicker may be shown to a user so that the display quality may be deteriorated.

In contrast, when the asymmetric data signal DATA is generated in the first frame of the variable frequency mode, the luminance difference between the first frame of the variable frequency mode and a previous frame may be minimized so that the flicker may be prevented.

As shown in FIG. 5, the driving controller 200 may generate the asymmetric data signal DATA for the grayscale value which is equal to or less than a threshold grayscale value GTH. The voltage-transmittance curve of FIG. 5 may be nonlinear for the voltage corresponding to the grayscale value which is equal to or less than the threshold grayscale value GTH so that the luminance compensation using the asymmetric data signal DATA may be more effective for the grayscale value which is equal to or less than the threshold grayscale value GTH.

Although the asymmetric data signal DATA is used for the grayscale value which is equal to or less than the threshold grayscale value GTH in the embodiment, the invention may not be limited thereto. The asymmetric data signal DATA may be used for entire grayscale area according to a voltage-transmittance characteristic of the display panel 100.

In FIG. 6, a first positive data signal VP1 and a first negative data signal VN1 are symmetric with respect to the common voltage VCOM so that the first positive data signal VP1 and the first negative data signal VN1 may represent the symmetric data signal. In FIG. 6, a second positive data signal VP2 and a second negative data signal VN2 are asymmetric with respect to the common voltage VCOM so that the second positive data signal VP2 and the second negative data signal VN2 may represent the asymmetric data signal.

In an embodiment, the second positive data signal VP2 of the asymmetric data signal may have a value less than a value of the first positive data signal VP1 of the symmetric data signal. In addition, the second negative data signal VN2 of the asymmetric data signal may have a value less than a value of the first negative data signal VN1 of the symmetric data signal.

In an alternative embodiment, the second positive data signal VP2 of the asymmetric data signal may be adjusted to have a value greater than the value of the first positive data signal VP1 of the symmetric data signal. In addition, the second negative data signal VN2 of the asymmetric data signal may be adjusted to have a value greater than the value of the first negative data signal VN1 of the symmetric data signal.

The luminance of the display image may be defined by a difference of the second positive data signal VP2 and the common voltage VCOM and a difference of the second negative data signal VN2 and the common voltage VCOM. Accordingly, when the second positive data signal VP2 and the second negative data signal VN2 of the asymmetric data have values respectively less than the values of the first positive data signal VP1 and the first negative data signal VN1 of the symmetric data, the luminance of the display image may not be decreased.

When the asymmetry between the second positive data signal VP2 and the second negative data signal VN2 increases, luminance of the display image may increase due to nonlinearity of the voltage-transmittance curve of FIG. 5.

FIG. 7 represents the asymmetric data signal DATA in the first frame T2-T3 of the variable frequency mode.

The asymmetric data signal DATA in the first frame T2-T3 of the variable frequency mode may be regardless of the input frequency and may be varied according to the grayscale value of the input image data IMG.

As shown in FIG. 7, a degree of the asymmetry of the asymmetric data signal DATA may be varied according to the grayscale value of the input image data IMG.

In the first frame T2-T3 of the variable frequency mode, the asymmetric data signal DATA may be determined based on a minimum frequency.

In the first frame T2-T3 of the variable frequency mode, there is no information of a previous frame so that the asymmetric data signal DATA regardless of the input frequency may be generated.

In subsequent frames T3-T4 (between the third time point T3 and a fourth time point T4) of the variable frequency mode after the first frame T2-T3 of the variable frequency mode, the driving controller 200 may generate the asymmetric data signal DATA having asymmetric values varied according to the input frequency and the grayscale value of the input image data IMG (operation S340).

Herein, in a second frame of the variable frequency mode, the driving controller 200 may generate the asymmetric data signal DATA based on the input frequency of the first frame of the variable frequency mode.

FIG. 8 represents the asymmetric data signal DATA in the subsequent frames T3-T4 of the variable frequency mode after the first frame T2-T3 of the variable frequency mode.

As shown in FIG. 8, a degree of the asymmetry of the asymmetric data signal DATA may be varied according to the grayscale value of the input image data IMG and varied according to the input frequency.

In the subsequent frames T3-T4 of the variable frequency mode after the first frame T2-T3 of the variable frequency mode, as the input frequency decreases, an absolute value of the asymmetric data signal DATA increases. In FIG. 8, the graph corresponding to the input frequency of about 240 Hz may be disposed closest to the common voltage VCOM and the graph corresponding to the input frequency of about 48 Hz may be disposed farthest from the common voltage VCOM.

In the subsequent frames T3-T4 of the variable frequency mode after the first frame T2-T3 of the variable frequency mode, a gap between the positive data signal and the negative data signal may be adjusted according to the frequency and the grayscale value to compensate the luminance of the display image with maintaining the degree of the asymmetric (an asymmetric ratio) of the first frame T2-T3.

In an embodiment, when grayscale values of 32, 64 and 128 are mapped to grayscale values of 27, 43 and 106 in a positive area and grayscale values of 45, 88 and 152 in a negative area for the frequency (a reference frequency) of about 240 Hz in the variable frequency mode, the positive data signal has a grayscale of 27 and the negative data signal has a grayscale of 45 for a grayscale of 32 of the input image data IMG having a frequency of about 240 Hz, the positive data signal has a grayscale of 43 and the negative data signal has a grayscale of 88 for a grayscale of 64 of the input image data IMG having the frequency of about 240 Hz, and the positive data signal has a grayscale of 106 and the negative data signal has a grayscale of 152 for a grayscale of 128 of the input image data IMG having the frequency of about 240 Hz, for example.

In a similar manner, the input image data IMG of the input frequency except for about 240 Hz may be converted into the data signal using curves in FIG. 8 for the input frequency except for about 240 Hz. In addition, the input image data IMG of the input frequency except for the frequencies illustrated in FIG. 8 may be generated by an interpolation method using the curves for the frequencies illustrated in FIG. 8.

Figure 9:
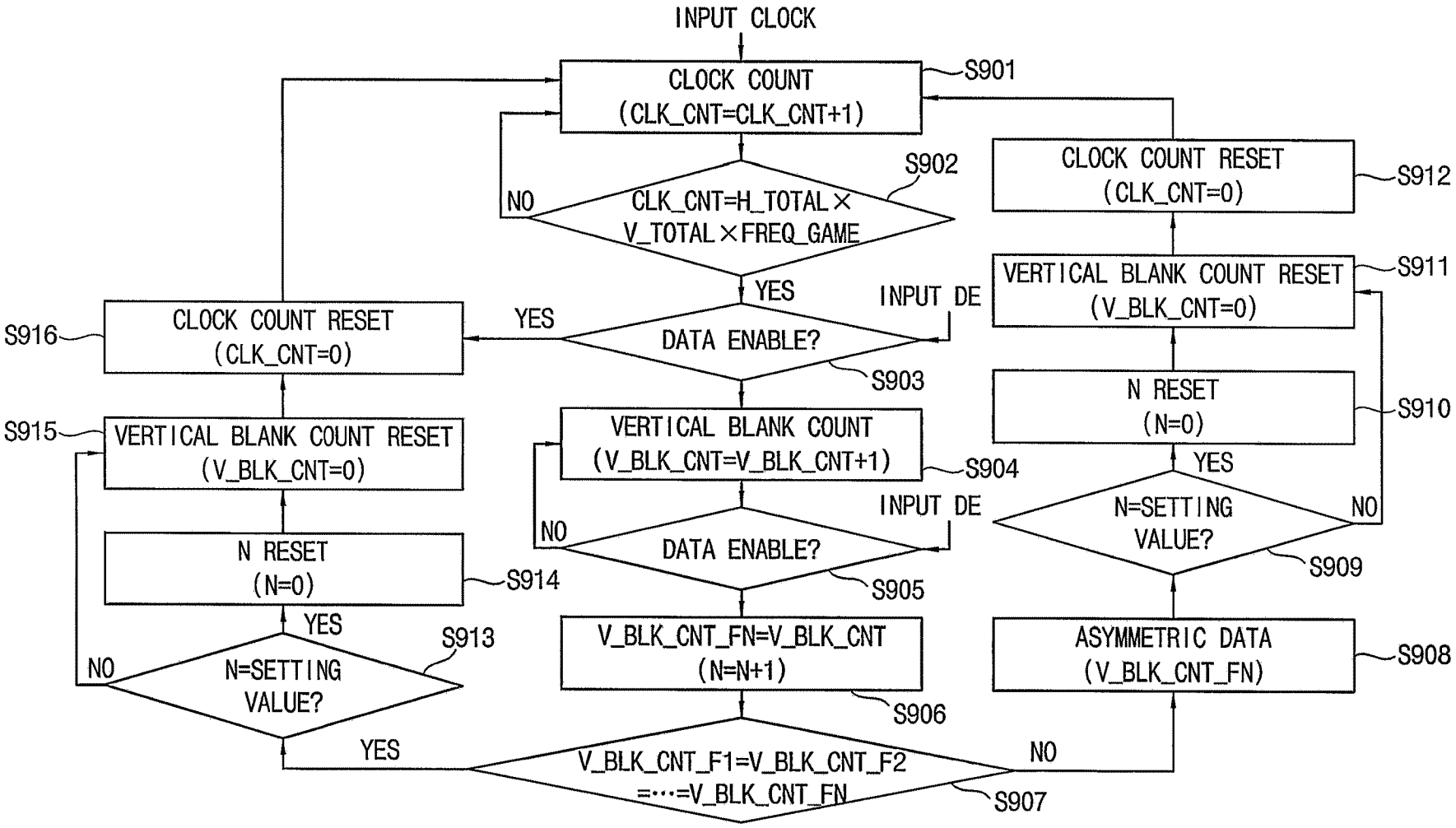
FIG. 9 is a flowchart illustrating the operation of the driving controller of FIG. 1.

FIG. 9 is a flowchart illustrating the operation of the driving controller 200 of FIG. 1.

Referring to FIGS. 1 to 9, an operation of S901 represents an operation of counting the pixel clock. In an operation of S902, it is determined whether a clock count CLK_CNT is equal to multiplication of the horizontal resolution H_TOTAL, the vertical resolution V_TOTAL and the maximum input frequency FREQ_GAME. In an operation of S903, when the clock count CLK_CNT is equal to multiplication of the horizontal resolution H_TOTAL, the vertical resolution V_TOTAL and the maximum input frequency FREQ_GAME, it is determined whether a data enable signal DE has an active status. Herein, when the data enable signal DE has an active status, the asymmetric data driving is not necessary so that the clock count may be reset (operation S916).

In an operation of S904 and an operation of S905, until the data enable signal DE is input, a vertical blank count may be accumulated to determine a length of the vertical blank period.

In an operation of S906, a length of a vertical blank period V_BLK_CNT_FN of each frame is determined using the length of the vertical blank period determined in the operations of S904 and S905.

In an operation of S907, when the lengths of the vertical blank periods V_BLK_CNT_FN of N frames are all the same, it is determined as the fixed frequency mode and it is determined that the asymmetric data driving is not necessary so that a reset process may be operated (operations S913, S914, S915 and S916).

In the operation of S907, when at least one of the lengths of the vertical blank periods V_BLK_CNT_FN of N frames is different, it is determined as the variable frequency mode so that the asymmetric data driving is operated (operation S908) and then the reset process may be operated (operations S909, S910, S911 and S912).

Figure 10:
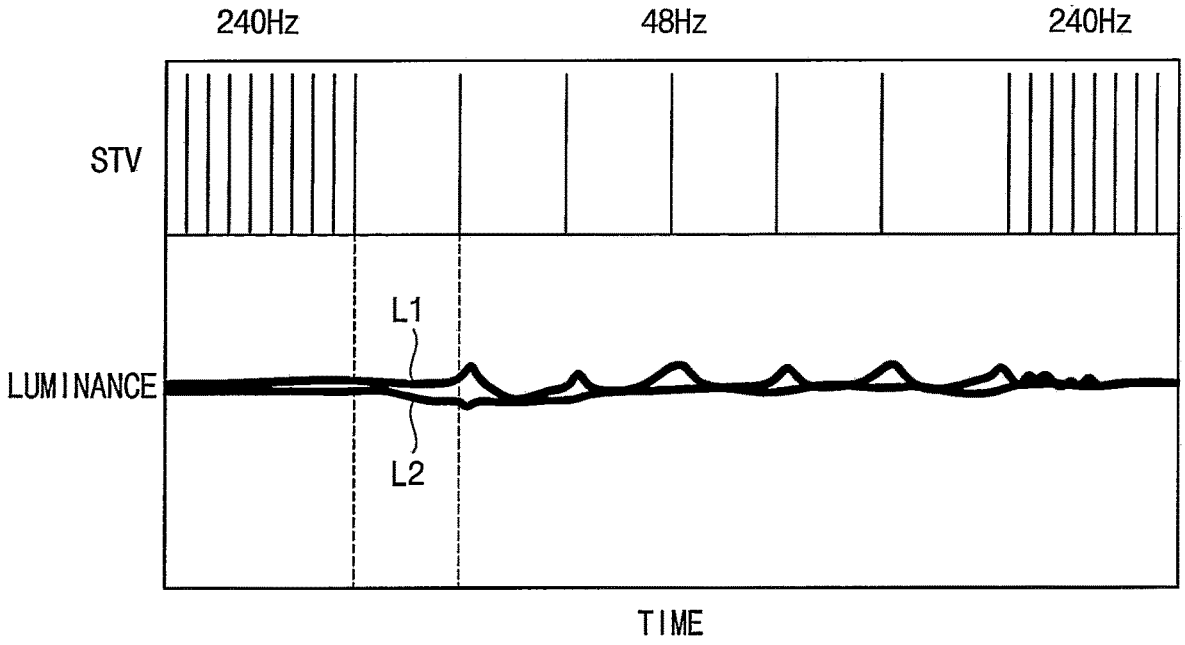
FIG. 10 is a graph illustrating a vertical start signal output from the driving controller of FIG. 1 and a luminance of the display panel of FIG. 1.

FIG. 10 is a graph illustrating a vertical start signal STV output from the driving controller 200 of FIG. 1 and a luminance of the display panel 100 of FIG. 1.

Referring to FIGS. 1 to 10, L1 in FIG. 10 represents an embodiment of a luminance curve and L2 in FIG. 10 represents a conventional luminance compensation method of a luminance curve. In the conventional luminance compensation method, as the length of the vertical blank period increases, a driving voltage of the data driver 500 increases so that the luminance decrease in the variable frequency mode may be compensated.

In the conventional luminance compensation method, the compensated driving voltage of the data driver 500 is applied to a next frame so that the luminance may be significantly decreased in a first frame of the variable frequency mode. In contrast, in the embodiment, the driving controller 200 may generate the asymmetric data signal DATA having an asymmetric value which is regardless of the input frequency and which is varied according to the grayscale value of the input image data IMG in the first frame T2-T3 of the variable frequency mode. Thus, when the asymmetric data signal DATA is generated in the first frame of the variable frequency mode, the luminance difference between the first frame of the variable frequency mode and a previous frame may be minimized so that the flicker may be prevented. In the luminance curve of the embodiment, a single frame latency problem may be solved using the asymmetric data signal DATA.

In addition, in the subsequent frames T3-T4 of the variable frequency mode after the first frame T2-T3 of the variable frequency mode, as the input frequency decreases, an absolute value of the asymmetric data signal DATA increases. In the subsequent frames T3-T4 of the variable frequency mode after the first frame T2-T3 of the variable frequency mode, a gap between the positive data signal and the negative data signal may be adjusted according to the frequency and the grayscale value to compensate the luminance of the display image with maintaining the degree of the asymmetric (an asymmetric ratio) of the first frame T2-T3. After the first frame T2-T3 of the variable frequency mode, the luminance decrease may be compensated using the asymmetric data signal DATA according to the frequency and the grayscale value so that the luminance uniformity may be enhanced in the variable frequency mode.

According to the embodiment, the display panel 100 is driven using the asymmetric data signal DATA having the positive data signal and the negative data signal which are asymmetric with respect to the common voltage in the variable frequency mode so that the difference of the luminance of the image according to the frequency may be prevented in the first frame T2-T3 of the variable frequency mode and in the subsequent frames T3-T4 of the variable frequency mode after the first frame T2-T3 of the variable frequency mode.

In addition, the variable frequency mode is accurately determined so that the display defect due to the asymmetric data signal in the fixed frequency mode may be prevented.

Thus, the display quality of the display panel 100 displaying the image in the variable frequency may be enhanced.

Figure 11:
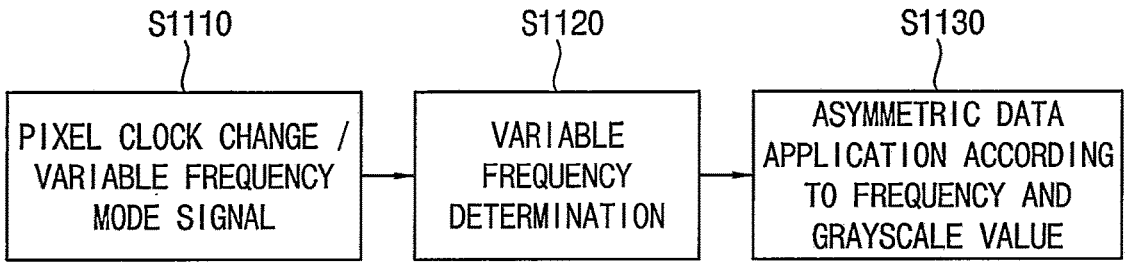
FIG. 11 is a conceptual diagram illustrating an embodiment of an operation of a driving controller of a display apparatus according to the invention.
Figure 12:
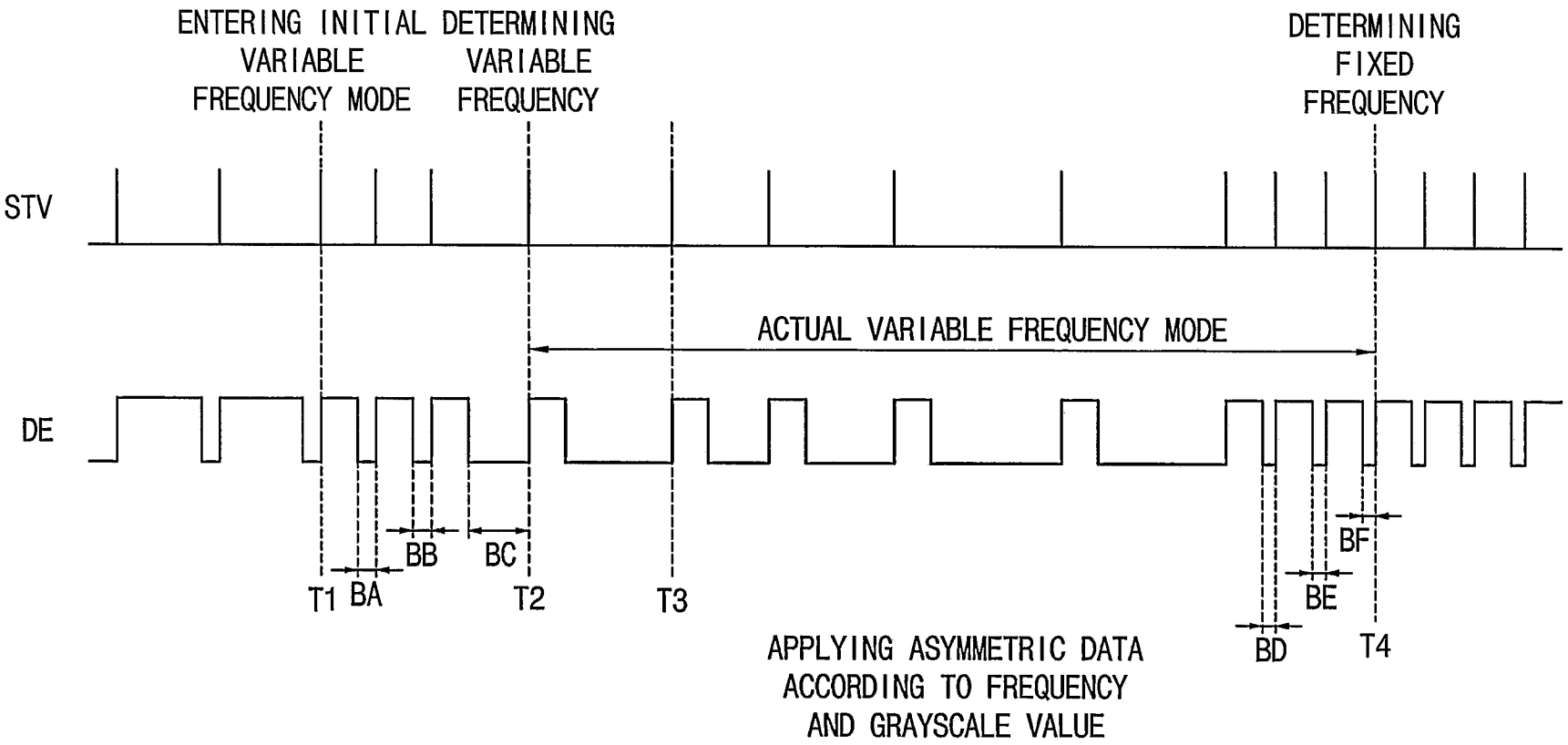
FIG. 12 is a timing diagram illustrating the operation of the driving controller of FIG. 11.

FIG. 11 is a conceptual diagram illustrating an embodiment of an operation of a driving controller of a display apparatus according to the invention. FIG. 12 is a timing diagram illustrating the operation of the driving controller of FIG. 11.

The display apparatus and the method of driving the display apparatus in the embodiment is substantially the same as the display apparatus and the method of driving the display apparatus of the previous embodiment explained referring to FIGS. 1 to 10 except for the structure and the operation of the driving controller. Thus, the same reference numerals will be used to refer to the same or like parts as those described in the previous embodiment of FIGS. 1 to 10 and any repetitive explanation concerning the above elements will be omitted.

Referring to FIGS. 1, 2 and 5 to 12, the display apparatus includes a display panel 100 and a display panel driver. The display panel driver includes a driving controller 200, a gate driver 300, a gamma reference voltage generator 400 and a data driver 500. The display apparatus may further include a host 600.

The driving controller 200 may determine a variable frequency mode and generate an asymmetric data signal DATA including a positive data signal and a negative data signal which are asymmetric with respect to a common voltage for the same grayscale value in the variable frequency mode.

The driving controller 200 may determine whether an initial variable frequency mode starts or not and determine whether the input frequency of the input image data IMG is changed in the initial variable frequency mode to accurately determine the variable frequency mode (operation S1110).

The driving controller 200 may determine whether the input frequency of the input image data IMG is changed in the initial variable frequency mode to determine the variable frequency mode (operation S1120).

In the embodiment, in a first frame T2-T3 of the variable frequency mode, the driving controller 200 may generate the asymmetric data signal DATA having asymmetric values varied according to the input frequency and the grayscale value of the input image data IMG (operation S1130).

In addition, in subsequent frames T3-T4 of the variable frequency mode after the first frame T2-T3 of the variable frequency mode, the driving controller 200 may generate the asymmetric data signal DATA having asymmetric values varied according to the input frequency and the grayscale value of the input image data IMG (operation S1130).

In the first frame T2-T3 of the variable frequency mode, the driving controller 200 may generate the asymmetric data signal DATA based on the input frequency of a last frame prior to the variable frequency mode.

In the second frame of the variable frequency mode, the driving controller 200 may generate the asymmetric data signal DATA based on the input frequency of the first frame T2-T3 of the variable frequency mode.

In FIGS. 3 and 4, in the first frame T2-T3 of the variable frequency mode, the driving controller 200 may generate the asymmetric data signal DATA having an asymmetric value which is regardless of the input frequency and which is varied according to the grayscale value of the input image data IMG. Unlike the embodiment in FIGS. 3 and 4, in FIGS. 11 and 12, the driving controller 200 may generate the asymmetric data signal DATA having an asymmetric value which is varied according to the input frequency and the grayscale value of the input image data IMG from the first frame T2-T3 of the variable frequency mode using the input frequency of the last frame prior to the variable frequency mode. In the embodiment, the asymmetric data signal DATA may be generated in the same way for the first frame of the variable frequency mode and for the remaining frames of the variable frequency mode so that the asymmetric data signal DATA may be generated by a concise logic compared to the previous embodiment and a similar effect to the previous embodiment may be obtained.

According to the embodiment, the display panel 100 is driven using the asymmetric data signal DATA having the positive data signal and the negative data signal which are asymmetric with respect to the common voltage in the variable frequency mode so that the difference of the luminance of the image according to the frequency may be prevented in the first frame T2-T3 of the variable frequency mode and in the subsequent frames T3-T4 of the variable frequency mode after the first frame T2-T3 of the variable frequency mode.

In addition, the variable frequency mode is accurately determined so that the display defect due to the asymmetric data signal in the fixed frequency mode may be prevented.

Thus, the display quality of the display panel 100 displaying the image in the variable frequency may be enhanced.

According to the invention as explained above, the power consumption of the display apparatus may be reduced and the display quality of the display panel may be enhanced.

The foregoing is illustrative of the invention and is not to be construed as limiting thereof. Although a few embodiments of the invention have been described, those skilled in the art will readily appreciate that many modifications are possible in the embodiments without materially departing from the novel teachings and advantages of the invention. Accordingly, all such modifications are intended to be included within the scope of the invention as defined in the claims. In the claims, means-plus-function clauses are intended to cover the structures described herein as performing the recited function and not only structural equivalents but also equivalent structures. Therefore, it is to be understood that the foregoing is illustrative of the invention and is not to be construed as limited to the specific embodiments disclosed, and that modifications to the disclosed embodiments, as well as other embodiments, are intended to be included within the scope of the inventive concept.

What is claimed is:

1. A display apparatus comprising:

a display panel;

a driving controller which processes input image data according to a variable input frequency and generates a data signal having a varied frame length; and a data driver which converts the data signal into a data voltage and outputs the data voltage to the display panel, wherein the driving controller determines a variable frequency mode and generates an asymmetric data signal including a positive data signal and a negative data signal which are only asymmetric with respect to a common voltage for a same grayscale value only in the variable frequency mode, and wherein the driving controller generates a symmetric data signal including a positive data signal and a negative data signal which are symmetric with respect to the common voltage for a same grayscale value in a fixed frequency mode.

2. The display apparatus of claim 1, wherein the driving controller determines whether an initial variable frequency mode starts or not, and wherein the driving controller determines that the variable input frequency of the input image data is changed in the initial variable frequency mode and determines the variable frequency mode.

3. The display apparatus of claim 2, wherein when a pixel clock of a present frame is equal to a pixel clock of a maximum input frequency, the driving controller determines that the initial variable frequency mode starts.

4. The display apparatus of claim 2, wherein when the driving controller receives a variable frequency mode signal from a host, the driving controller determines that the initial variable frequency mode starts.

5. The display apparatus of claim 2, wherein the driving controller compares lengths of vertical blank periods of N frames, where N is a natural number equal to or greater than two, and determines that the variable input frequency changes when at least one of the vertical blank periods has a different length.

6. The display apparatus of claim 2, wherein when the variable input frequency of the input image data is determined to be fixed, the variable frequency mode is terminated.

7. The display apparatus of claim 6, wherein the driving controller compares lengths of vertical blank periods of N frames, where N is a natural number equal to or greater than two, and determines that the variable input frequency is fixed when the lengths of the vertical blank periods of the N frames are identical.

8. The display apparatus of claim 1, wherein the driving controller generates the asymmetric data signal having an asymmetric value which is regardless of the variable input frequency and which is varied according to a grayscale value of the input image data in a first frame of the variable frequency mode.

9. The display apparatus of claim 8, wherein the driving controller generates the asymmetric data signal having an asymmetric value varied according to the variable input frequency and the grayscale value of the input image data in subsequent frames of the variable frequency mode after the first frame of the variable frequency mode.

10. The display apparatus of claim 9, wherein in a second frame of the variable frequency mode, the driving controller generates the asymmetric data signal based on the variable input frequency of the first frame of the variable frequency mode.

11. The display apparatus of claim 1, wherein the driving controller generates the asymmetric data signal having an asymmetric value varied according to the variable input frequency and a grayscale value of the input image data in the variable frequency mode.

12. The display apparatus of claim 11, wherein in a first frame of the variable frequency mode, the driving controller generates the asymmetric data signal based on an input frequency of a last frame prior to the variable frequency mode.

13. The display apparatus of claim 1, wherein the driving controller generates the asymmetric data signal for a grayscale value which is equal to or less than a threshold grayscale value.

14. The display apparatus of claim 1, wherein the positive data signal of the asymmetric data signal has a value less than a value of a positive data signal of the symmetric data signal, and wherein the negative data signal of the asymmetric data signal has a value less than a value of a negative data signal of the symmetric data signal.

15. A method of driving a display apparatus, the method comprising:

processing input image data according to a variable input frequency to generate a data signal having a varied frame length;

converting the data signal into a data voltage; and outputting the data voltage to a display panel, wherein the processing the input image data comprises:

determining a variable frequency mode;

generating an asymmetric data signal including a positive data signal and a negative data signal which are only asymmetric with respect to a common voltage for a same grayscale value only in the variable frequency mode; and generating a symmetric data signal including a positive data signal and a negative data signal which are symmetric with respect to the common voltage for a same grayscale value in a fixed frequency mode.

16. The method of claim 15, wherein the determining the variable frequency mode comprises:

determining whether an initial variable frequency mode starts or not; and determining that the variable input frequency of the input image data is changed in the initial variable frequency mode to determine the variable frequency mode.

17. The method of claim 16, wherein the determining the variable frequency mode further comprises:

determining that the variable frequency mode is terminated when the variable input frequency of the input image data is determined to be fixed.

18. The method of claim 15, wherein the asymmetric data signal has an asymmetric value which is regardless of the variable input frequency and which is varied according to a grayscale value of the input image data in a first frame of the variable frequency mode.

19. The method of claim 18, wherein the asymmetric data signal has an asymmetric value varied according to the variable input frequency and the grayscale value of the input image data in subsequent frames of the variable frequency mode after the first frame of the variable frequency mode.

20. The method of claim 15, wherein the asymmetric data signal has an asymmetric value varied according to the variable input frequency and a grayscale value of the input image data in the variable frequency mode.

* * * * *